US010829692B2

(12) United States Patent
Yang et al.

(10) Patent No.: US 10,829,692 B2
(45) Date of Patent: Nov. 10, 2020

(54) AUTOMATIC DEHYDRATION, EXTRACTION AND TRANSPORTATION APPARATUS FOR PETROLEUM COKE

(71) Applicant: LUOYANG JIANGUANG SPECIAL EQUIPMENT CO., LTD, Henan (CN)

(72) Inventors: Genchang Yang, Luoyang (CN); Qingtao Yang, Luoyang (CN); Zhiping Liu, Luoyang (CN)

(73) Assignee: LUOYANG JIANGUANG SPECIAL EQUIPMENT CO., LTD, Luoyang (CN)

( * ) Notice: Subject to any disclaimer, the term of this patent is extended or adjusted under 35 U.S.C. 154(b) by 0 days.

(21) Appl. No.: 16/478,587

(22) PCT Filed: May 10, 2017

(86) PCT No.: PCT/CN2017/083727
§ 371 (c)(1),
(2) Date: Jul. 17, 2019

(87) PCT Pub. No.: WO2018/205162
PCT Pub. Date: Nov. 15, 2018

(65) Prior Publication Data

US 2020/0040260 A1 Feb. 6, 2020

(51) Int. Cl.

| | |
|---|---|
| ***C10B 33/00*** | (2006.01) |
| ***C10B 43/08*** | (2006.01) |
| ***C10B 55/00*** | (2006.01) |

(52) U.S. Cl.
CPC ..... *C10B 33/006* (2013.01); *C10B 43/08* (2013.01); *C10B 55/00* (2013.01)

(58) Field of Classification Search
None
See application file for complete search history.

(56) References Cited

U.S. PATENT DOCUMENTS

| | | | |
|---|---|---|---|
| 8,147,689 | B1 | 4/2012 | Cogar |
| 2003/0192819 | A1 | 10/2003 | Casey et al. |

(Continued)

FOREIGN PATENT DOCUMENTS

| | | | |
|---|---|---|---|
| CN | 204660877 | U | 9/2015 |
| CN | 105567289 | A | 5/2016 |

OTHER PUBLICATIONS

Nov. 12, 2019 International Preliminary Report on Patentability issued in Internation Application No. PCT/CN2017/083727.

(Continued)

*Primary Examiner* — Derek N Mueller
(74) *Attorney, Agent, or Firm* — Oliff PLC

(57) ABSTRACT

An automatic dehydration, extraction and transportation apparatus for petroleum coke, includes a bottom cover device, crusher, coke chute and extracting device. The bottom cover device is at the bottom of a coke tower and connected to a coke storage pool via the chute. A grid net for filtering petroleum coke is horizontally provided in the lower part of the pool. A partition door is on an end, away from the chute, of a side pool wall of the pool. The extracting device enters and exits the coke storage pool through the partition door. A partition wall is between the partition door and the chute. The surface of the partition wall is opposite the chute, such that a corridor is formed between the other pool wall opposite the chute and the partition wall. One end of the partition wall is connected to the pool wall provided with the partition door.

9 Claims, 2 Drawing Sheets

(56) References Cited

U.S. PATENT DOCUMENTS

| | | | | |
|---|---|---|---|---|
| 2005/0126902 | A1* | 6/2005 | Magaldi | C10B 33/00 202/241 |
| 2006/0042926 | A1* | 3/2006 | Lu | C10B 25/10 202/242 |
| 2014/0083469 | A1* | 3/2014 | Liu | C10B 33/006 134/110 |
| 2014/0110243 | A1* | 4/2014 | Lah | C10B 25/10 202/241 |

OTHER PUBLICATIONS

Feb. 12, 2018 Written Opinion issued in International Application No. PCT/CN2017/083727.
Feb. 12, 2018 International Search Report issued in International Application No. PCT/CN2017/083727.

* cited by examiner

AUTOMATIC DEHYDRATION, EXTRACTION AND TRANSPORTATION APPARATUS FOR PETROLEUM COKE

BACKGROUND

Technical Field

The present invention belongs to the technical field of hydraulic decoking of delayed coking, and in particular relates to an automatic dehydration, extraction and transportation apparatus for petroleum coke.

Related Art

Delayed coking is a heavy oil deep processing process for converting heavy oil into gas, light medium distillate and coke through deep thermal cracking, which has the characteristics of thorough decarbonization, simple process, mature technology and low investment in apparatuses, and has become one of the important processes in the heavy oil processing technology.

With the increase of the proportion of heavy and inferior crude oil, and the progress of deep processing of crude oil, delayed coking is becoming more and more important in processing heavy and inferior crude oil, and the output of petroleum coke is increasing. At present, China's consumption of crude oil is about 0.35 billion tons. At present, there are about 60 sets of delayed coking units using vacuum residue or vacuum residue blended asphalt and catalytic slurry oil as raw materials, and the processing capacity is about 78 Mt/a. There are nearly 50 sets of delayed coking units using heavy crude oil, heavy fuel oil or coal tar as raw materials, and the total processing capacity is about 3-5 Mt/a. At the end of 2010, the total processing capacity of delayed coking in China exceeds 110 Mt/a. By calculation according to 35% of crude coke, China will produce more than 10 million tons of petroleum coke every year. Decoking and coke transportation are an important part of the delayed coking process. In the prior art, hydraulic decoking is commonly used in delayed coking units, where high pressure water is used to cut petroleum coke in a coke tower, and then the coke flows into a coke storage pool together with water via a coke chute. The coke storage pool also having a storage function is open in the air. Decoking water in the pool flows to a filter pool and is recycled. By using a grab cane, the coke in the pool is dumped or grabbed to an outward transport train or vehicle bucket by bucket, or grabbed to a grid of a belt conveying system. In the process of dumping and grab transporting, it is inevitable that the material is scattered. Coke and coke powder cause pollution to the surrounding environment. The coke powder falls on the ground, there is a smell of coke volatiles in the air, the environment is polluted, and damage to the health of operating workers is caused. There will also be security accidents such as fires. Therefore, it is of great significance to develop an automatic dehydration, extraction and transportation apparatus for petroleum coke.

SUMMARY

The present invention is directed to an automatic dehydration, extraction and transportation apparatus for petroleum coke, which can achieve coke dehydration, extraction and transportation, as well as effective and environmentally-friendly collection and transportation of petroleum coke.

To solve the above technical problem, the present invention adopts the following technical solution: an automatic dehydration, extraction and transportation apparatus for petroleum coke includes a bottom cover device, a coke chute, a coke storage pool, and an extracting device. The bottom cover device is arranged at the bottom of a coke tower and connected to the coke storage pool via the coke chute. The top of the coke storage pool is open and the bottom is horizontally provided with a grid net for filtering petroleum coke.

A track is provided at the top of a pool wall of the coke storage pool. The extracting device is movable along the track. A hoist stretching from the extracting device to the coke storage pool extracts the petroleum coke on the grid net. A partition door is provided on the pool wall of the coke storage pool. The hoist enters and exits the coke storage pool through the partition door.

A partition wall is further provided in the coke storage pool, and the surface of the partition wall is opposite the coke chute, such that a corridor is formed between a pool wall opposite the coke chute and the partition wall, the partition door being located at an end of the corridor communicating with the outside. One end of the partition wall is connected to the pool wall of the coke storage pool while spacing is reserved between the other end and the opposite pool wall. After the petroleum coke flushed into the coke storage pool along the coke chute is blocked and buffered by the partition wall, a part of the petroleum coke bypasses the partition wall and enters the corridor circuitously, so as to weaken an impact of the petroleum coke on the partition door.

Preferably, the pool bottom of the coke storage pool is sequentially provided with a plurality of grooves in a direction of the petroleum coke entering the coke storage pool, the length direction of the grooves is perpendicular to the direction of the petroleum coke entering the coke storage pool, one end of each groove communicates with the same flow channel, and the grid net covers the groove.

Preferably, the coke storage pool is provided with a coke flusher, the coke flusher being provided on the pool wall of the coke storage pool connected to the coke chute, and the coke flusher being located above the grid net.

Preferably, a flushing pipeline and a flushing water outlet pipeline are connected to the pool wall of the coke storage pool below the grid net, the flushing pipeline is provided with nozzles corresponding to the grooves and spraying water into the corresponding grooves to remove the petroleum coke deposited in the grooves, the flushing water outlet pipeline is connected to a return line outside the coke storage pool, after flowing out from the flushing water outlet pipeline, water filtered in the coke storage pool is fed into the coke flusher via the return line and sprayed toward the grid net from the coke flusher to spread the petroleum coke on the grid net, and powder coke contained in the sprayed water is secondarily filtered by a gap between the petroleum cokes.

Preferably, the return line includes a water collecting tank and a pump, a water collecting tank inlet is connected to the flushing water outlet pipeline, a water collecting tank outlet is connected to a water inlet end of the pump, a water outlet end of the pump is connected to one end of a pump return line via a pump outlet pipeline, the other end of the pump return line is connected to the coke flusher, and a pump return line valve is provided on the pump return line.

Preferably, the pump outlet pipeline is provided with a drainage branch for installing a pump outlet valve, and the pump return line is connected to an external pressure water pipeline via a three-way joint.

Preferably, the water collecting tank is provided with an inspection port and a vent, the vent being connected to the coke storage pool via a vent pipeline.

Preferably, a crusher is provided between the bottom cover device and the coke chute to crush the petroleum coke dropping from the coke tower.

Preferably, the extracting device further includes an extractor trolley, an extractor cart and a horizontal conveyor, a screw hoist is provided on a horizontal track of the extractor cart by means of the extractor trolley and is movable along the horizontal track, the horizontal conveyor is provided on the extractor cart with one end connected to the screw hoist and the other end connected to an external transportation system via an extractor discharge port on the extractor cart, the extractor cart travels along the track at the top of the pool wall of the coke storage pool, and the direction of travel of the extractor cart is perpendicular to the direction of movement of the extractor trolley.

Compared with the prior art, the present invention has the following beneficial effects:

Firstly, the apparatus has the functions of storing, dehydrating, extracting and transporting petroleum coke, and same can not only improve the transportation efficiency but also thoroughly improve the surrounding environment, and may meet the needs of petroleum, chemical engineering and other fields.

Secondly, the apparatus is horizontally provided with the grid net, after petroleum coke and decoking water enter the coke storage pool, a water surface will flow over the grid net. As the filtration progresses, the water surface gradually drops below the grid net. If the extracting device is designed in the pool, the lower part of the screw hoist is closer to a net surface of the grid net for convenience of extraction since the height of the screw hoist is not adjustable. Therefore, the lower part of the screw hoist will soak in the decoking water for a long time, and the decoking water will corrode the screw hoist, which greatly affects the service life of the screw hoist. Therefore, the apparatus is designed in such a way that the extracting device enters, during the extraction, the coke storage pool and then exits the coke storage pool after completing extraction, thereby avoiding corrosion of the screw hoist and prolonging the service life.

Thirdly, to cooperate with the extracting device, particularly the screw hoist, to enter and exit the coke storage pool, the partition door is provided on the pool wall. Since the decoking water and the petroleum coke are flushed into the coke storage pool from the coke chute, the pool wall and the partition door may be heavily impacted, and the strength and sealing property of the partition door are highly required. However, the partition door is provided in the pool of the apparatus, the partition wall and the pool wall define the corridor, and the partition door is provided on the other side of the partition wall, so that when the decoking water and the petroleum coke are flushed into the pool, they need to bypass a channel at the end portion of the partition wall to flow toward the corridor circuitously due to the blockage of the partition wall, and finally they flow to the partition door slowly, thereby reducing the impact force on the partition door. In actual production, the requirements for strength and sealing property caused by processing of the partition door are reduced.

Fourthly, in actual production, the decoking water is mixed with a large amount of powder coke. Waste water mixed with the powder coke, including decoking water and flushing water, can be pressurized by the pump and then sprayed from the coke flusher. On the one hand, the petroleum coke deposited on the grid net can be flushed away by the sprayed water to be spread. Moreover, the petroleum coke on the grid net can also be used for secondarily filtering the powder coke in the water.

Figure 1:
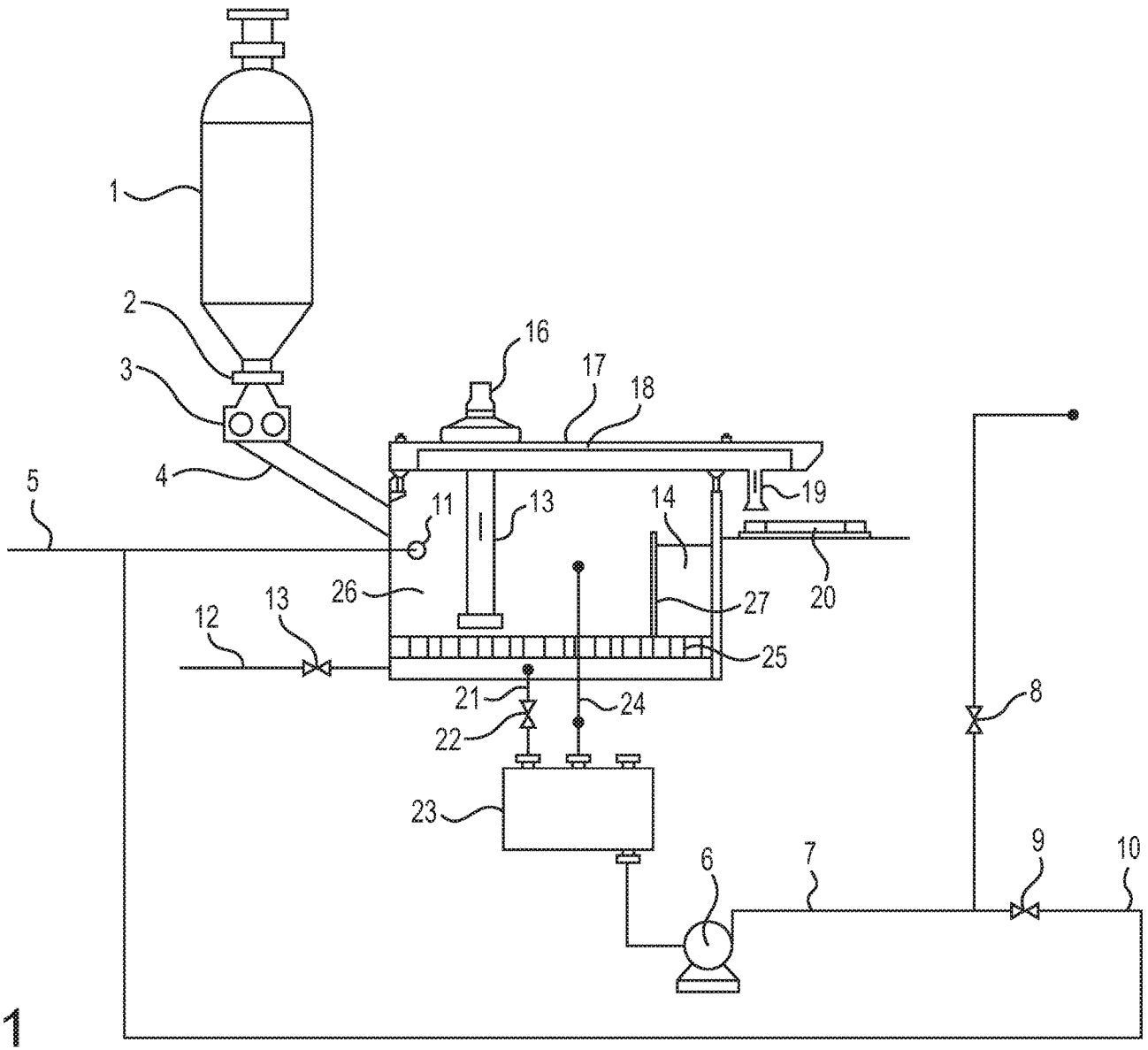
FIG. 1 is a structural diagram of the present invention.
Figure 2:
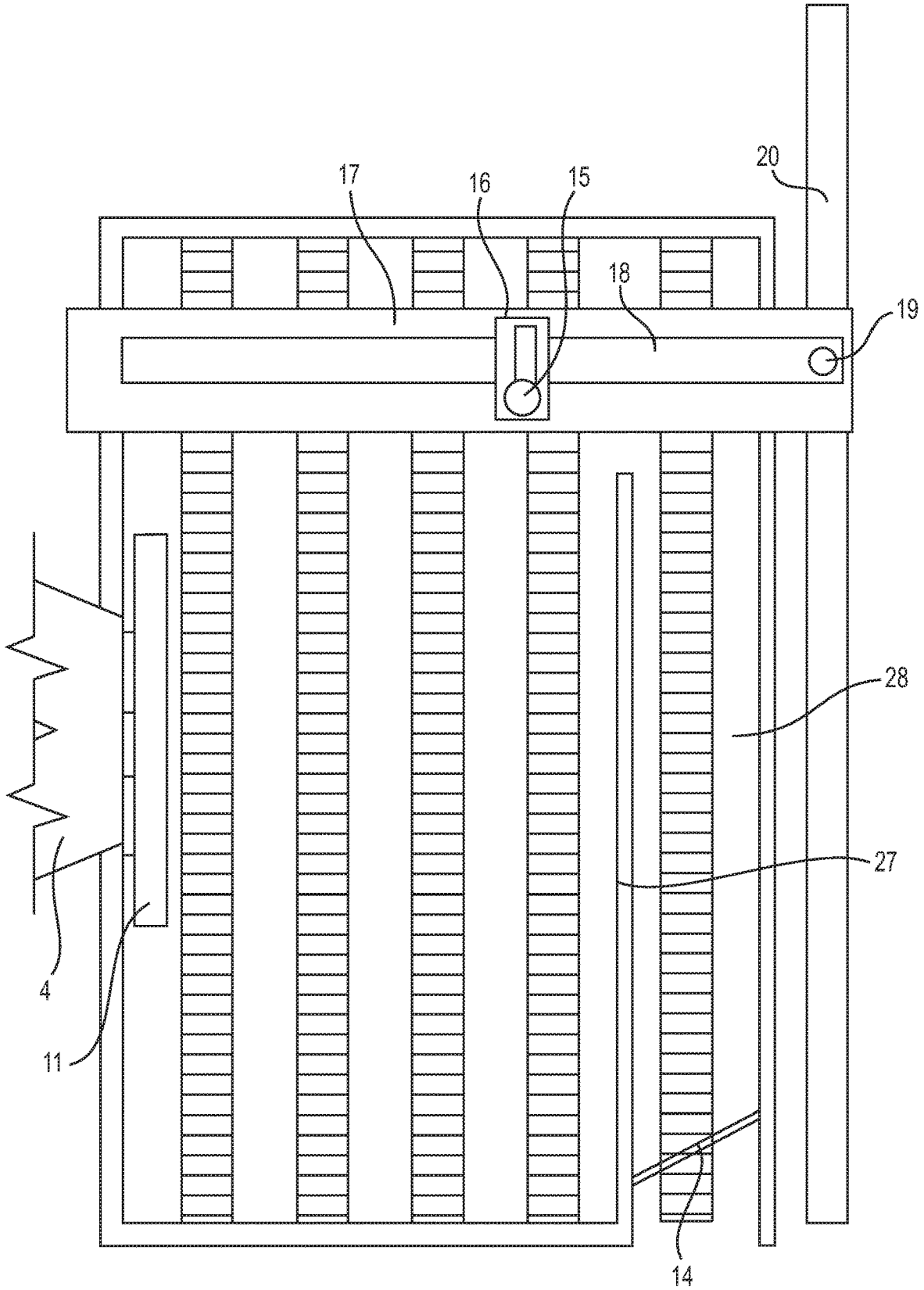
FIG. 2 is a top view of a coke storage pool.

Reference signs in the drawings: 1, coke tower, 2, bottom cover device, 3, crusher, 4, coke chute, 5, external pressure water pipeline, 6, pump, 7, pump outlet pipeline, 8, pump outlet valve, 9, pump return line valve, 10, pump return line, 11, coke flusher, 12, flushing pipeline, 13, flushing pipeline valve, 14, partition door, 15, screw hoist, 16, extractor trolley, 17, extractor cart, 18, horizontal conveyor, 19, extractor discharge port, 20, belt conveyor, 21, flushing water outlet pipeline, 22, flushing water outlet valve, 23, water collecting tank, 24, vent pipeline, 25, grid net, 26, coke storage pool, 27, partition wall, and 28, corridor.

DETAILED DESCRIPTION

The technical solution of the present invention will be further described by way of specific embodiments with reference to the accompanying drawings.

An automatic dehydration, extraction and transportation apparatus for petroleum coke is shown in the figures. The apparatus, connected to a coke tower 1, includes a bottom cover device 2, a crusher 3, a coke chute 4, a coke storage pool 26, a water collecting tank 23, a pump 6, and an extracting device. The bottom cover device 2 is arranged at the bottom of the coke tower 1. The bottom cover device 2 is connected to the crusher 3. An outlet of the crusher 3 is connected to the coke storage pool 26 via the inclined coke chute 4.

The coke storage pool 26 is of a top-open structure. A plurality of parallel grooves is provided at the bottom of the pool in a direction of petroleum coke entering the coke storage pool. The length direction of the grooves is perpendicular to the direction of entry of the petroleum coke. Water outlets of all grooves communicate with the same flow channel, the direction of the flow channel being perpendicular to the direction of the grooves. A grid net 25 is installed on each groove. A net surface of the grid net 25 is flush with the bottom surface of the pool on both sides of the groove. A flushing pipeline 12 is connected to a pool wall of the coke storage pool 26. The flushing pipeline 12 has branches communicating the respective grooves, and a nozzle corresponding to the groove is provided on each branch. The nozzle sprays water into the groove, and the direction of water spraying is toward the communication end of the groove and the flow channel, and the petroleum coke deposited in the groove is flushed.

The flow channel is provided with a flushing water outlet, and is connected to the water collecting tank 23 via a flushing water outlet pipeline 21. The water collecting tank 23 is further provided with a vent, a water tank outlet and an inspection port. The vent is connected to the coke storage pool 26 via a vent pipeline 24. The water tank outlet is connected to a water inlet end of the pump 6. A pump outlet pipeline 7 is provided with a pump outlet valve 8 and is connected to one end of a pump return line 10 via a three-way joint. The other end of the pump return line 10 is connected to an external pressure water pipeline 5 via a three-way joint. The pump return line 10 is provided with a pump return line valve 9.

A coke flusher 11 is provided at an end in the coke storage pool 26 close to the coke chute 4. The coke flusher 11 is located at the lower part of the pool wall connected to the coke chute 4. The coke flusher 11 is connected to the external pressure water pipeline 5 and the pump return line 10. Introduced pressurized water is sprayed toward the petroleum coke accumulated on the grid net 25 to spread the petroleum coke on the grid net 25.

A track is provided at the top of a pair of parallel tool walls of the coke storage pool 26. The extracting device moves along the track at the top of the coke storage pool 26. A hoist stretching from the extracting device to the coke storage pool 26 extracts the petroleum coke on the grid net 25. The hoist enters and exits the coke storage pool 26 through a partition door 14 provided on the pool wall of the coke storage pool 26. A partition wall 27 is provided in the coke storage pool 26, and the surface of the partition wall 27 is opposite the coke chute 4, such that a corridor 28 is formed between a pool wall opposite the coke chute 4 and the partition wall 27. The length of the partition wall is smaller than the width of the coke storage pool 26, such that one end of the partition wall 27 is connected to the pool wall of the coke storage pool 26 while spacing is reserved between the other end and the opposite pool wall to form a channel communicating spaces on both sides of the partition wall 27. After the petroleum coke flushed into the coke storage pool 26 along the coke chute 4 is blocked and buffered by the partition wall 27, a part of the petroleum coke changes a flow direction, bypasses the partition wall 27 and enters the corridor 28 circuitously, so as to weaken the impact of the petroleum coke on the partition door 14.

The extracting device further includes an extractor trolley 16, an extractor cart 17 and a horizontal conveyor 18. The hoist adopts a screw hoist 15. The extractor cart 17 is supported by the tops of the pool walls of both ends of the coke storage pool 26 by moving wheels provided at the bottom, and moves along the track on the pool wall. The screw hoist 15 is provided on the extractor cart 17 by means of the extractor trolley 16 and is movable in a plane of the extractor cart 17. The horizontal conveyor 18 is provided on the extractor cart 17. The petroleum coke extracted by the screw hoist 15 enters the horizontal conveyor 18 and fed toward one end of the extractor cart 17 by the horizontal conveyor 18. The tail end of the horizontal conveyor 18 is connected to an extractor discharge port 19. A belt conveyor 20 is provided below the extractor discharge port 19 as an external transportation system.

The working principle of the apparatus is as follows:

The apparatus has the functions of storing, dehydrating, extracting and transporting petroleum coke. Under the action of high pressure water, after output from the coke tower 1, the petroleum coke enters the crusher 3 through the bottom cover device 2. After being crushed by the crusher 3, the petroleum coke is output into the coke storage pool 26 via the coke chute 4 and falls on the grid net 25. The coke flusher 11 introduces pressure water via the external pressure water pipeline 5, and flushes and spreads the petroleum coke stacked on the grid net 25. The petroleum coke is filtered and dehydrated by the grid net 25, and filter water and decoking water flow into the water collecting tank 23 together through the flow channel and the flushing water outlet pipeline 21. The flushing pipeline 12 is introduced into the coke storage pool, and the branches of the flushing pipeline 12 are provided with the nozzles corresponding to the grooves. Therefore, water sprayed by the flushing pipeline 12 may dredge the groove to avoid agglomeration of the petroleum coke, or may flush away agglomeration to avoid clogging. The flushed water flows into the water collecting tank 23 along with the decoking water and the filter water, and the water in the water collecting tank 23 may be conveyed to a subsequent baffling pool via the pump outlet pipeline 7. In the initial stage of decoking, the decoking water and the flushing water contain a large amount of powder coke. After the decoking water and the flushing water are pressurized by the pump 6, they may be sprayed from the pump return line 10 via the coke flusher 11 to spread the petroleum coke on the grid net 25 in the coke storage pool 26.

Moreover, the petroleum coke on the grid net 25 can also secondarily filter the returned decoking water. The partition wall 14 is opened, the screw hoist 15 of the extracting device enters the coke storage pool 26 via the partition door 14, and under the movement of the respective tracks of the extractor cart 17 and the extractor trolley 16, the screw hoist 15 moves in the pool via the corridor 28 formed by the partition wall 27 and the channel.

During the extraction, by the movement of the extractor trolley 16 and the extractor cart 17 in the perpendicular direction, the screw hoist 15 can stay at different positions to hoist the petroleum coke on the grid net 25 to the horizontal conveyor 18, and the petroleum coke is conveyed to the belt conveyor 20 of the external transportation system via the horizontal conveyor 18. After completing the extraction, the extracting device exits the coke storage pool 26, and the partition door 14 is closed.

When the bottom cover device 2 is opened, the petroleum coke in the coke tower 1 is flushed into the coke storage pool 26 along the coke chute 4 together with the decoking water. After the petroleum coke and the decoking water are impacted on the partition wall 27, the speed is slowed down, and a part of the petroleum coke and decoking water change the flow direction, bypass the end portion of the partition wall 27, and flow to the corridor 28 circuitously. At this time, the flow rate of the petroleum coke and the decoking water is low, and the partition door 14 at the end portion of the corridor 28 cannot be heavily impacted. Therefore, requirements for the strength and sealing property of the partition door 14 are greatly reduced.

What is claimed is:

1. An automatic dehydration, extraction and transportation apparatus for petroleum coke, comprising a bottom cover device, a coke chute, and a coke storage pool, wherein:

the bottom cover device is arranged at a bottom of a coke tower and connected to the coke storage pool via the coke chute, a bottom of the coke storage pool is horizontally provided with a grid net for filtering petroleum coke, a track is provided at a top of a first pool wall of the coke storage pool, a hoist is configured to extract the petroleum coke on the grid net, a partition door is provided on the first pool wall of the coke storage pool, and the hoist enters and exits the coke storage pool through the partition door, a partition wall is further provided in the coke storage pool, a surface of the partition wall is opposite the coke chute, such that a corridor is formed between the first pool wall opposite the coke chute and the partition wall, the partition door being located at an end of the corridor communicating with an area outside of the coke storage pool, a first end of the partition wall is connected to a second pool wall of the coke storage pool and a second end of the partition wall opposite the first end of the partition wall is spaced from a third pool wall of the coke storage pool opposite the second pool wall of the coke storage pool, and the partition wall is situated within the coke storage pool such that, after the petroleum coke flushed into the coke storage pool along the coke chute is blocked and buffered by the partition wall, a part of the petroleum coke bypasses the partition wall and enters the corridor circuitously, so as to weaken an impact of the petroleum coke on the partition door.

2. The automatic dehydration, extraction and transportation apparatus for petroleum coke according to claim 1, wherein the bottom of the coke storage pool is sequentially provided with a plurality of grooves in a direction of the petroleum coke entering the coke storage pool, a length direction of the grooves is perpendicular to the direction of the petroleum coke entering the coke storage pool, one end of each groove communicates with a same flow channel, and the grid net covers the groove.

3. The automatic dehydration, extraction and transportation apparatus for petroleum coke according to claim 1, wherein the coke storage pool is provided with a coke flusher, the coke flusher is provided on a fourth pool wall of the coke storage pool connected to the coke chute that is opposite the first pool wall of the coke storage pool, and the coke flusher being located above the grid net.

4. The automatic dehydration, extraction and transportation apparatus for petroleum coke according to claim 3, wherein a flushing pipeline and a flushing water outlet pipeline are connected to the coke storage pool below the grid net, the flushing pipeline is provided with nozzles corresponding to the grooves and spraying water into the corresponding grooves to remove the petroleum coke deposited in the grooves, the flushing water outlet pipeline is connected to a return line in the area outside of the coke storage pool, after flowing out from the flushing water outlet pipeline, water filtered in the coke storage pool is fed into the coke flusher via the return line and sprayed toward the grid net from the coke flusher to spread the petroleum coke on the grid net, and powdery coke contained in the sprayed water is secondarily filtered by a gap between petroleum cokes.

5. The automatic dehydration, extraction and transportation apparatus for petroleum coke according to claim 4, wherein the return line comprises a water collecting tank and a pump, a water collecting tank inlet is connected to the flushing water outlet pipeline, a water collecting tank outlet is connected to a water inlet end of the pump, a water outlet end of the pump is connected to one end of a pump return line via a pump outlet pipeline, the other end of the pump return line is connected to the coke flusher, and a pump return line valve is provided on the pump return line.

6. The automatic dehydration, extraction and transportation apparatus for petroleum coke according to claim 5, wherein the pump outlet pipeline is provided with a drainage branch, and the pump return line is connected to an external pressure water pipeline via a three-way joint.

7. The automatic dehydration, extraction and transportation apparatus for petroleum coke according to claim 5, wherein the water collecting tank is provided with an inspection port and a vent, the vent being connected to the coke storage pool via a vent pipeline.

8. The automatic dehydration, extraction and transportation apparatus for petroleum coke according to claim 1, wherein a crusher is provided between the bottom cover device and the coke chute to crush the petroleum coke dropping from the coke tower.

9. The automatic dehydration, extraction and transportation apparatus for petroleum coke according to claim 1, further comprising an extractor trolley, an extractor cart and a horizontal conveyor, wherein:

the hoist is a screw hoist, the screw hoist is provided on a horizontal track of the extractor cart by means of the extractor trolley and is movable along the horizontal track, the horizontal conveyor is provided on the extractor cart with one end connected to the screw hoist and the other end connected to an external transportation system via an extractor discharge port on the extractor cart, the extractor cart travels along the track at the top of the first pool wall of the coke storage pool, and the direction of travel of the extractor cart is perpendicular to the direction of movement of the extractor trolley.

* * * * *